US005302342A

United States Patent [19]

Kawabe et al.

[11] Patent Number: 5,302,342

[45] Date of Patent: Apr. 12, 1994

[54] ALUMINUM ALLOY FOR HEAT EXCHANGERS

[75] Inventors: Tsuyoshi Kawabe; Nobuaki Yamamoto, both of Utsunomiyashi; Tadayoshi Hayashi, Fujimishi; Makoto Tanio, Sakaishi; Ichiro Iwai, Oyamashi; Ichizo Tsukuda, Kishiwadashi; Ryotatsu Otsuka, Osakashi, all of Japan

[73] Assignees: Honda Giken Kogyo Kabushiki Kaisha; Showa Aluminum Kabushiki Kaisha, Japan

[21] Appl. No.: 92,761

[22] Filed: Jul. 16, 1993

Related U.S. Application Data

[63] Continuation of Ser. No. 785,863, Oct. 28, 1991, abandoned, which is a continuation of Ser. No. 606,712, Oct. 31, 1990, abandoned.

[30] Foreign Application Priority Data

Nov. 17, 1989 [JP] Japan ..... 1-300132

[51] Int. Cl.[5] ..... C22C 21/00

[52] U.S. Cl. ..... 420/546; 420/547; 420/548; 420/550

[58] Field of Search ..... 420/533, 534, 538, 542, 420/546, 547, 548, 550

[56] References Cited

U.S. PATENT DOCUMENTS

| | | | |
|---|---|---|---|
| 3,697,260 | 10/1972 | Hunsicker | 420/534 |
| 3,859,059 | 1/1975 | Anthony et al. | 428/654 |
| 4,072,542 | 2/1978 | Murakado et al. | 148/440 |
| 4,257,854 | 3/1981 | Daenen et al. | 204/36 |
| 4,845,543 | 4/1989 | Okikawa et al. | 420/542 |
| 4,943,492 | 7/1990 | Holroyd et al. | 428/654 |

FOREIGN PATENT DOCUMENTS

| | | |
|---|---|---|
| 239995 | 10/1987 | European Pat. Off. . |
| 61-166939 | 7/1986 | Japan . |
| 61-272341 | 12/1986 | Japan . |
| 62-128746 | 6/1987 | Japan . |
| 62-158033 | 7/1987 | Japan . |
| 62-170334 | 7/1987 | Japan . |
| 63-14836 | 1/1988 | Japan . |
| 63-250110 | 10/1988 | Japan . |
| 63-250111 | 10/1988 | Japan . |
| 63-250112 | 10/1988 | Japan . |
| 63-312941 | 12/1988 | Japan . |
| 1-79339 | 3/1989 | Japan . |
| 1-198443 | 8/1989 | Japan . |
| 1-259142 | 10/1989 | Japan . |
| 2-129337 | 5/1990 | Japan . |
| 8802411 | 4/1988 | World Int. Prop. O. . |

*Primary Examiner*—George Wyszomierski

[57] ABSTRACT

An aluminum alloy for heat exchangers, the alloy, comprising a base compostion selected from a group consisting of Al-Mg-Si composition containing 0.1 to 0.8 wt % of Mg, 0.2 to 1.0 wt % of Si and 0.3 to 1.5 wt % of Mn; pure-Al composition; Al-Mg composition containing 0.05 to 1.0 wt % of Mg; and a Al-Zn composition containing 0.05 to 2.0 wt % of Zn. The alloy further comprises 0.01 to 0.3 wt % of Fe and/or 0.01 to 0.3 wt % of Ni, wherein the balance are aluminum of purity of 99.9% or higher and unavoidable impurities contained therein, and content of Cu as one of the impurities is controlled to be 0.05 wt % or less.

2 Claims, 1 Drawing Sheet

ALUMINUM ALLOY FOR HEAT EXCHANGERS

This application is a continuation of application Ser. No. 785,863, filed Oct. 28, 1991, which is a continuation of application Ser. No. 606,712, filed Oct. 31, 1990, both abandoned.

BACKGROUND OF THE INVENTION

1. Field of the Invention

The present invention relates to an aluminum alloy used to manufacture tubular elements or other members of heat exchangers such as those incorporated in radiators, car heaters, intercoolers or the likes.

2. Description of the Prior Art

The aluminum alloy "A3003" has been used in general to manufacture structural elements such as the tubular elements which allow a heat exchanging medium to flow therethrough, because the alloy "A3003" is easy to treat in the manufacturing processes.

Higher contents of impurities such as iron (Fe) in the aluminum alloy A3003 cause inferior corrosion resistance thereof at room temperature or near temperatures close thereto. Efforts have been made to improve the corrosion resistance at such lower temperatures, by making the impurity contents as low as possible. However in this case, there arises a new problem that intercrystalline corrosion takes place at higher temperatures including 100° C., i.e., the boiling temperature of water and near temperatures close thereto. Corrosion of such a type causes cracks in the tubular elements.

In view of those problems and particularly in a case in which water or other corrosive heat-exchanging medium is likely to be employed for the heat exchangers in radiators or the likes, tubes of aluminum alloy A3003 are used as "cores" of tubular elements and their inner surfaces are covered with a lining layer of another aluminum alloy such as "A7072" or "A5005". The alloy A7072 functions as a sacrificial anodic layer, and the other alloy A5005 is comparatively highly corrosion-resistant.

These aluminum alloys A7075 and A5005 used as the lining layer are also not satisfactory because their corrosion resistance becomes worse at or near room temperature with a rich content of Fe, and because a lower Fe content reduced to improve the corrosion resistance at lower temperatures will give rise to the problem of intercrystalline corrosion at higher temperature of or near 100° C.

There has been still another problem that the mechanical strength is often lowered for instance to about 4 Kgf/mm$^2$ as a value of $\sigma$0.2 ( tolerable load ) after the structural members of heat exchangers made of the alloy "A3003" are soldered to each other. Thus, walls constituting the tubular elements or other members are to be inevitably made thicker to assure sufficient strength thereof. Therefore, manufacturers have inevitably had to accept a larger size, an excessive weight and a higher manufacture cost of the known heat exchangers. The abovementioned problems have occurred not only in the tubular elements but also in the other structural members of heat exchangers made of such aluminum alloys.

OBJECTS AND SUMMARY OF THE INVENTION

Therefore, an object of the invention is to provide an aluminum alloy which is of an improved corrosion resistance at lower temperatures in a range from about 20° C. to 50° C. ( hereinafter referred to as "low-temperature corrosion resistance") and is thus a material suited to manufacture structural members such as tubular elements or inner lining layers thereof in the heat exchangers.

Another object of the invention is to provide an aluminum alloy for heat exchangers which alloy is not only excellent in its low-temperature corrosion resistance but also is of an improved resistance to intercrystalline corrosion at higher temperatures of or near 100° C. ( hereinafter referred to as "high-temperature intercrystalline corrosion resistance").

The objects are accomplished herein by providing an aluminum alloy which comprises: a base alloy composition selected from a first group consisting of a first composition containing aluminum (Al), magnesium (Mg) and silicon (Si), a second composition containing pure aluminum (Al), a third composition containing aluminum (Al) and magnesium (Mg), and a fourth composition containing aluminum (Al) and zinc (Zn); controlled amounts of one or more additional ingredients selected from a second group consisting of iron (Fe) and nickel (Ni); and a controlled amount of copper (Cu) as an unavoidable impurity, wherein metal purity of aluminum as a major ingredient is also controlled.

In detail, the invention provides the aluminum alloy called "Al-Mg-Si alloy", "pure-Al alloy", "Al-Mg alloy" or "Al-Zn alloy" which are based on the abovementioned first, second, third or fourth composition respectively.

The Al-Mg-Si alloy for heat exchangers comprises 0.1 to 0.8 wt % of Mg, 0.2 to 1.0 wt % of Si, and 0.3 to 1.5 wt % of manganese (Mn), further comprising 0.01 to 0.3 wt % of Fe and/or 0.01 to 0.3 wt % of Ni, wherein the balance are aluminum of purity of 99.9% or higher and unavoidable impurities contained therein, and Cu content is controlled to be 0.05 wt % or less.

The pure-Al alloy for heat exchangers comprises 0.01 to 0.3 wt % of Fe and/or 0.01 to 0.3 wt % of Ni, wherein the balance are aluminum of purity of 99.9% or higher and unavoidable impurities contained therein, and Cu content is controlled to be 0.05 wt % or less.

The Al-Mg alloy for heat exchangers comprises 0.05 to 1.0 wt % of Mg, further comprising 0.01 to 0.3 wt % of Fe and/or 0.01 to 0.3 wt % of Ni, wherein the balance are aluminum of purity of 99.9% or higher and unavoidable impurities contained therein, and Cu content is controlled to be 0.05 wt % or less.

The Al-Zn alloy for heat exchangers comprises 0.05 to 2.0 wt % of Zn, further comprising 0.01 to 0.3 wt % of Fe and/or 0.01 to 0.3 wt % of Ni, wherein the balance are aluminum of purity of 99.9% or higher and unavoidable impurities contained therein, and Cu content is controlled to be 0.05 wt % or less.

Other objects, features and advantages of the invention will become apparent from the description given hereinafter referring to the drawings.

DETAILED DESCRIPTION OF PREFERRED EMBODIMENTS

Figure 1:
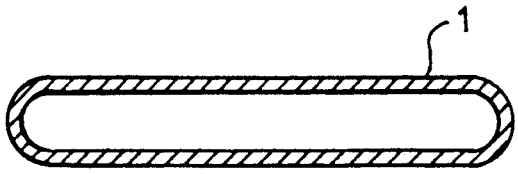
FIG. 1 is a cross section of a tubular element for a heat exchanger, the tubular element made of an aluminum alloy provided in the invention.

Metallic or other elements contained in aluminum alloys are explained at first as to their functions, limited contents and the reasons why the contents are so limited.

Al-Mg-Si alloy is suited particularly to manufacture 'bare' member or core member for tubular elements. Mg in this alloy is effective to improve mechanical strength of soldered structural members of heat exchangers. A lower content of Mg below 0.1 wt % renders poor such an effect whereas a higher content above 0.8 wt % causes the soldering to become imperfect. Thus, the most preferable range of Mg content is from about 0.2 to about 0.5 wt %.

Si is useful also to improve the mechanical strength of the soldered members. A lower content of Si below 0.2 wt % renders poor such an effect whereas a higher content above 1.0 wt % causes the soldering to become imperfect. Thus, the most preferable range of Si content is above 0.4 wt % but up to 0.7 wt %.

Mn improves corrosion resistance and mechanical strength of the members. A lower content of Mn below 0.3 wt % renders poor such an effect whereas this effect is saturated with a content of or more than 1.5 wt % so that a higher content above 1.5 wt % gives no merit which can compensate an excessively raised cost. Further, such a high content gives rise to such coarse crystals that will make poor the workability of the material. Therefore, Mn content must fall most preferably within a range from 0.5 to 1.2 wt %.

Pure-Al alloy, Al-Mg alloy and Al-Zn alloy are particularly suited for use as a lining material for the tubular elements.

Mg contained in Al-Mg alloy improves corrosion resistance and 'sacrificial corrosion property' thereof. A poor content of Mg below 0.05 wt % will render insufficient this effect, while an excessive content above 1.0 wt % brings about saturation of such an effect. The most desirable content of Mg is from 0.3 to 0.8 wt %.

Zn contained in Al-Zn alloy gives it the sacrificial corrosion property. Zn content less than 0.05 wt % renders insufficient this effect, but a higher Zn content more than 2.0 wt % undesirably accelerates corrosion of the alloy. Thus, the most desirable content of Zn is from 0.3 to 1.5 wt %. Fe and/or Ni are necessarily contained in all the alloys mentioned above in order to give them the high-temperature intercrystalline corrosion resistance. Fe and Ni are equivalent to each other in respect of this effect so that at least one of them is to be contained. If both of them are contained at contents less than 0.01 wt %, then such an effect becomes negligible. Contrarily, if more than 0.3 wt % of Fe or Ni is contained, then the low-temperature corrosion resistance becomes poor. Therefore, the most desirable contents of Fe and Ni are 0.03 to 0.15 wt % and 0.03 to 0.15 wt %, respectively.

The balance of each alloy containing aforementioned necessary elements is aluminum and unavoidable impurities contained therein. Purity of aluminum metal is to be of 99.9% or higher in order to improve the low-temperature corrosion resistance by decreasing said impurities to as low content as possible. Such a high purity of aluminum will make it easy to control the contents of Fe and/or Ni to fall within the desirable range mentioned above. Aluminum metal of a purity of 99.99% or higher is most desirable. Aluminum metal qualified as a grade of 99.9% or higher purity may be employed to control the aluminum content in the balance to be 99.9% or more. Among the unavoidable impurities contained in the alloys, Cu makes poor the corrosion resistance of said alloys so that its content should be 0.05 wt % or less.

The aluminum alloys in the invention may be used to manufacture the structural members of heat exchangers wherein said alloys may be extruded into pipes or plates, or may be drawn after extruded. Alternatively, said alloy may be rolled at first into a shape of plate and thereafter seam-welded or upset-welded into a shape of pipe, if necessary. There is no limitation on what conventional method other than those known methods may be employed.

Figure 2:
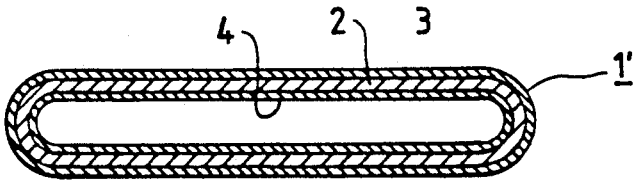
FIG. 2 is a cross section showing a modification of the tubular element.

The aluminum alloys provided in the invention may be used as 'bare' material to manufacture such a tubular element 1 as shown in FIG. 1. They are usable also to a composite material as shown in FIG. 2 wherein an outer surface of a core 2 made of such an alloy is covered with a layer 3 of a soldering agent which may be an-aluminum-silicon alloy, thus forming a different kind of a tubular element 1'. The layer 3 which may be applied to the core 2 by the cladding method or any other suitable method will make it easy to solder the tubular element 1' to fin members not shown in FIG. 1. On the other hand, the pure-Al alloy, Al-Mg alloy and Al-Zn alloy provided in the invention are desirably used to form an inner lining layer 4 as shown in FIG. 2, the lining layer being applied to the core 2 of the Al-Mg-Si alloy provided in the invention.

It is to be noted that, as will become apparent from the Examples described below, the aluminum alloys provided in the invention so as to be used to manufacture heat exchangers are excellent in their low-temperature corrosion resistance and also in their high-temperature intercrystalline corrosion resistance. Thus, the aluminum alloys are highly corrosion-resistant in a wide temperature range, so that they can be advantageously used as the tubular element or the lining layer and prolong the life of the heat exchangers made of such an element and layer.

Further, the Al-Mg-Si alloy which the invention provides is not only excellent in its corrosion resistance as described above but also is easy to work to the same degree as the known alloy "A3003". Besides, the structural members made of Al-Mg-Si alloy are of a higher strength after they are soldered one another. Furthermore, the structural members can be made thinner as to their wall thickness, thus decreasing their weights and at the same time lowering their manufacture costs.

EXAMPLES

Examples of the aluminum alloys in the invention will now be described in detail.

# Example 1

This example is for Al-Mg-Si alloys.

The aluminum alloys listed on Table 1 were molten, cast into desired shapes and then subjected to homogenizing treatment. The thus prepared alloys were hot-rolled at 500° C., and subjected to intermediate annealing process for 2 hours at 370° C. before cold-rolled and finally heat-treated at 600° C. for 5 minutes. Test pieces of 1.0 mm in thickness were made in this way as the tubular elements for heat exchangers.

The abovementioned test pieces were used to perform the following tests, i.e., soldering test, strength measurement of soldered members, corrosion tests on inner surfaces and on outer surfaces. The corrosion tests were carried out taking into account respectively the inner and outer environments in which the the members would be used.

TABLE 1

| Alloys | | Composition (weight %) Mg | Si | Mn | Fe | Ni | Cu | Ti | Zn | Al (Purity) |
|---|---|---|---|---|---|---|---|---|---|---|
| Invention | 1 | 0.77 | 0.36 | 0.98 | 0.27 | — | — | — | — | Bal.(≧99.9%) |
| | 2 | 0.45 | 0.62 | 0.70 | 0.05 | — | — | — | — | Bal.(≧99.9%) |
| | 3 | 0.56 | 0.58 | 1.12 | 0.08 | — | — | — | — | Bal.(≧99.9%) |
| | 4 | 0.38 | 0.75 | 1.00 | 0.10 | — | — | — | — | Bal.(≧99.9%) |
| | 5 | 0.18 | 0.85 | 0.45 | — | 0.06 | — | — | — | Bal.(≧99.9%) |
| | 6 | 0.43 | 0.67 | 0.55 | — | 0.26 | — | — | — | Bal.(≧99.9%) |
| | 7 | 0.42 | 0.44 | 1.40 | 0.08 | 0.20 | — | — | — | Bal.(≧99.9%) |
| | 8 | 0.46 | 0.70 | 0.60 | 0.16 | 0.11 | — | — | — | Bal.(≧99.9%) |
| Reference | 9 | 1.00 | 0.69 | 0.62 | — | — | — | — | — | Bal.(≧99.9%) |
| | 10 | 0.37 | 1.21 | 0.84 | 0.35 | — | — | — | — | Bal.(≧99.9%) |
| | 11 | 0.46 | 0.66 | 0.15 | 0.06 | — | 0.09 | — | — | Bal.(≧99.9%) |
| | 12 | 0.42 | 0.68 | 1.58 | 0.13 | 0.34 | — | — | — | Bal.(≧99.9%) |
| | 13 | 0.06 | 0.18 | 0.98 | — | — | — | — | — | Bal.(≧99.9%) |
| | 14 | — | 0.21 | 1.11 | 0.53 | — | 0.12 | 0.02 | — | Bal. (*1) |
| | 15 | — | 0.18 | — | 0.16 | — | — | — | 1.03 | Bal. (*2) |

Notes:
*1 is the alloy "A3003", *2 is the alloy "A7072", and "Bal." denotes "balance".

(1) Soldering Tests

Figure 3:
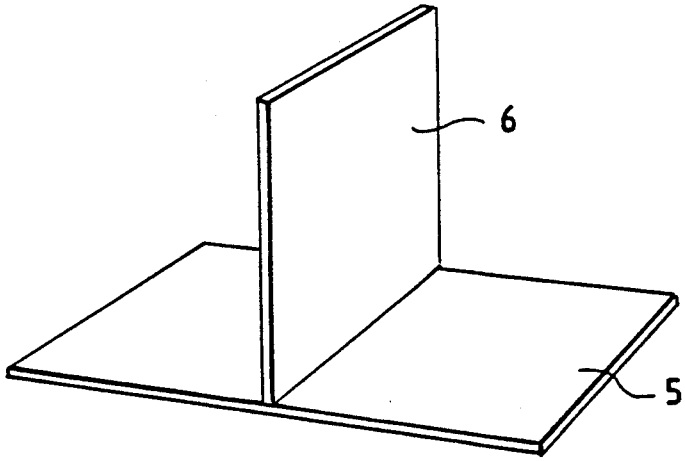
FIG. 3 is a perspective view showing a combined state of test pieces used in a soldering test carried out in embodiments.

Each test piece had a dimension of 50 mm in width and 50 mm in length so as to be soldered to an objective piece which comprised a core of the alloy A3003 and a soldering agent layer of "BA4045" cladded to both sides of the core. The test piece 5 and the objective piece 6 were combined to be of a T-shape as shown in FIG. 3. The soldering was carried out using a fluoride flux within a nitrogen gas at 600° C. for 5 minutes, and thereafter generation of fillets at soldered regions was visually inspected.

(2) Strength Measurement of Soldered Members

Tensile strength was carried out on other pieces of 50 mm in width and 300 mm in length which had been heated in the nitrogen atmosphere at the same time as the test pieces.

(3) Corrosion Test on Inner Surface

Test pieces of 40 mm in width and 70 mm in length were immersed in the ASTM solution comprising "decuple water" plus 10 ppm of Cu++, at 95° C. and 50° C. for 500 hours, respectively. Corrosion of these test pieces was checked subsequently.

(4) Corrosion Test on Outer Surface

The saltwater-spraying test according to the standard of JIS-Z-2371 was conducted for 1,000 hours for each of other test pieces which were 40 mm in width and 70 mm in length. Corrosion of these test pieces was checked subsequently.

Results obtained by these tests are given on Table 2.

As will be seen on Table 2, the alloy Nos. 1 to 8 provided by the invention as the material to manufacture tubular elements of heat exchangers are readily soldered and easy to work to the same degree as the known alloy "A3003", i.e., the reference No. 14. Further, the alloys ( Nos. 1 to 8 ) proved sufficiently strong even after soldered and excellent not only in their low-temperature corrosion resistance but also in their high-temperature intercrystalline corrosion resistance.

TABLE 2

| Alloys | Solder-ability | Strength after Soldered σ0.2 (*1) | Rating (*2) | Cor. Resist. of In. Surf.(*3) (95° C.) | (50° C.) | Cor. Resist. of Out. Surf. (*4) |
|---|---|---|---|---|---|---|
| Invention | | | | | | |
| 1 | Good | 8.0 | Sup. | P. ≦ 0.1 mm | P. ≦ 0.1 mm | P. ≦ 0.1 mm |
| 2 | Good | 7.7 | Sup. | P. ≦ 0.1 mm | P. ≦ 0.1 mm | P. ≦ 0.1 mm |
| 3 | Good | 7.9 | Sup. | P. ≦ 0.1 mm | P. ≦ 0.1 mm | P. ≦ 0.1 mm |
| 4 | Good | 8.0 | Sup. | P. ≦ 0.1 mm | P. ≦ 0.1 mm | P. ≦ 0.1 mm |
| 5 | Good | 7.4 | Sup. | P. ≦ 0.1 mm | P. ≦ 0.1 mm | P. ≦ 0.1 mm |
| 6 | Good | 8.2 | Sup. | P. ≦ 0.1 mm | P. ≦ 0.1 mm | P. ≦ 0.1 mm |
| 7 | Good | 7.5 | Sup. | P. ≦ 0.1 mm | P. ≦ 0.1 mm | P. ≦ 0.1 mm |
| 8 | Good | 8.6 | Sup. | P. ≦ 0.1 mm | P. ≦ 0.1 mm | P. ≦ 0.1 mm |
| Reference | | | | | | |
| 9(*5) | No good | 14.0 | Sup. | I/C 0.4 mm | P. ≦ 0.1 mm | P. ≦ 0.1 mm |
| 10(*6) | No good | 15.0 | Sup. | P. ≦ 0.1 mm | P. 0.2 mm | P. ≦ 0.1 mm |
| 11 | Good | 7.3 | Sup. | P. ≦ 0.1 mm | P. ≦ 0.1 mm | P. 0.3 mm |
| 12(*7) | Good | 7.6 | Sup. | P. ≦ 0.1 mm | P. 0.2 mm | P. ≦ 0.1 mm |
| 13 | Good | 4.0 | Inf. | I/C 0.4 mm | P. ≦ 0.1 mm | P. ≦ 0.1 mm |
| 14 | Good | 4.3 | Inf. | P. ≦ 0.1 mm | P. 0.2 mm | P. ≦ 0.1 mm |

TABLE 2-continued

| Alloys | Solder-ability | Strength after Soldered σ0.2 (*1) | Strength after Soldered Rating (*2) | Cor. Resist. of In. Surf.(*3) (95° C.) | Cor. Resist. of In. Surf.(*3) (50° C.) | Cor. Resist. of Out. Surf. (*4) |
|---|---|---|---|---|---|---|
| 15(*8) | Good | 2.0 | Inf. | Sf. 0.1 mm | Sf. 0.1 mm | Sf. 0.1 mm |

Notes:
*1; Kgf/mm$^2$
*2; "Sup." denotes 'superior' indicating strength of 7 Kgf/mm$^2$ or more, and "Inf." denotes 'inferior' indicating strength below 5 Kgf/mm$^2$.
*3; Corrosion resistance of inner surface, and
*4; Corrosion resistance of outer surface, wherein "P. " denotes 'pinhole' corrosion, "I/C" denotes 'intercrystalline' corrosion, and "Sf." denotes 'surface' corrosion accompanied by many corrosive products.
*5; Ununiformed generation of fillets was observed.
*6; Intercrystalline erosion was observed near the fillets.
*7; Generation of coarse crystals was observed.
*8; Surface corrosion with many corroded products.

In contrast with the alloys in the invention, the reference alloy Nos. 9 and 13 which do not contain Fe nor Ni are inferior to those in the invention in the high-temperature intercrystalline corrosion. The other reference alloy Nos. 10 and 12 containing excessive amounts of Fe and/or Ni are insufficient in their low-temperature corrosion resistance. Solderability of the reference alloy Nos. 9 and 10 which contains excessive amounts of Mg or Si is worse than those in the invention. Lower corrosion resistance of outer surface was observed for the other reference alloy No. 11 which contained less amount of Mn and an excessive amount of Cu as one of the impurities. The reference alloy No. 12 containing an excessive amount of Mn has proved bad in its workability due to generation of an intermetallic compound indicated with "Al-Fe-Mn". The further reference alloy Nos. 13 and 14, the latter being A3003, were found inferior to the other alloys in the strength after soldered.

Example 2

This example is for the pure-Al alloys.

Corrosion tests were performed for the test pieces in the following manner. Namely, the test pieces of 40 mm in width and 70 mm in length were immersed in the ASTM solution comprising "decuple water" plus 10 ppm of Cu ++, at 95° C. and 50° C. for 500 hours, respectively. Corrosion of these test pieces which had been immersed in the solution was checked subsequently, and gave the results listed on Table 3.

It will be seen from Table 3 that the aluminum alloy Nos. 16 to 20 provided by the invention to manufacture heat exchangers proved corrosion-resistant with their excellent low-temperature corrosion resistance and high-temperature intercrystalline corrosion resistance. The reference alloy No. 21 lacking Fe and Ni proved inferior to them in the high-temperature intercrystalline corrosion resistance. The other reference alloy No. 22 rich in Ni was found bad in its low-temperature corrosion resistance, whereas the further reference alloy 23 rich in Cu as one of the unavoidable impurities proved inferior to the alloys in the invention in both types of the corrosion resistance.

TABLE 3

| Alloys | Composition (wt %) Fe | Ni | Cu | Al (purity) | Corrosion resistance at 95° C. | at 50° C. |
|---|---|---|---|---|---|---|
| Invention | | | | | | |
| 16 | 0.02 | — | — | Bal.(≧99.9%) | Pin. ≦ 0.1 mm | Pin. ≦ 0.1 mm |
| 17 | 0.28 | — | — | Bal.(≧99.9%) | Pin. ≦ 0.1 mm | Pin. ≦ 0.1 mm |
| 18 | — | 0.02 | — | Bal.(≧99.9%) | Pin. ≦ 0.1 mm | Pin. ≦ 0.1 mm |
| 19 | — | 0.27 | — | Bal.(≧99.9%) | Pin. ≦ 0.1 mm | Pin. ≦ 0.1 mm |
| 20 | 0.11 | 0.14 | — | Bal.(≧99.9%) | Pin. ≦ 0.1 mm | Pin. ≦ 0.1 mm |
| Reference | | | | | | |
| 21 | — | — | — | Bal.(≧99.9%) | I/C 0.4 mm | Pin. ≦ 0.1 mm |
| 22 | — | 0.38 | — | Bal.(≧99.9%) | Pin. 0.2 mm | Pin. 0.3 mm |
| 21 | 0.05 | — | 0.14 | Bal. | Pin. 0.3 mm | Pin. 0.3 mm |

Notes:
"Bal." denotes 'balance', "Pin. " denotes 'pinhole'. and "I/C" denotes 'intercrystalline corrosion'.

The aluminum alloys listed on Table 3 were molten, cast into desired shapes and then subjected to homogenizing treatment. The thus prepared alloys were hot-rolled at 500° C., and subjected to intermediate annealing process for 2 hours at 370° C. before cold-rolled and finally heat-treated at 600° C. for 5 minutes. Test pieces of 1.0 mm in thickness were made in this way as the tubular elements for heat exchangers.

Example 3

This example is for the Al-Mg alloys.

Aluminum alloys listed on Table 4 were formed into test pieces representative of the tubular elements in heat exchangers, on the same condition as that in Example 2.

The test pieces were subjected to the same corrosion tests as those in Example 2, the results obtained being listed on Table 4.

TABLE 4

| Alloys | Composition (wt %) Mg | Fe | Ni | Cu | Al (purity) | Corrosion resistance at 95° C. | at 50° C. |
|---|---|---|---|---|---|---|---|
| Invention | | | | | | | |
| 24 | 0.50 | 0.18 | — | — | Bal.(≧99.9%) | Pin. ≦ 0.1 mm | Pin. ≦ 0.1 mm |

TABLE 4-continued

| Alloys | Composition (wt %) Mg | Fe | Ni | Cu | Al (purity) | Corrosion resistance at 95° C. | at 50° C. |
|---|---|---|---|---|---|---|---|
| 25 | 0.98 | — | 0.23 | — | Bal.(≧99.9%) | Pin. ≦ 0.1 mm | Pin. ≦ 0.1 mm |
| 26 | 0.22 | 0.10 | — | — | Bal.(≧99.9%) | Pin. ≦ 0.1 mm | Pin. ≦ 0.1 mm |
| 27 | 0.65 | 0.16 | 0.11 | — | Bal.(≧99.9%) | Pin. ≦ 0.1 mm | Pin. ≦ 0.1 mm |
| Reference | | | | | | | |
| 28 | 0.80 | — | — | — | Bal.(≧99.9%) | I/C 0.4 mm | Pin. ≦ 0.1 mm |
| 29 | 0.68 | 0.42 | — | — | Bal.(≧99.9%) | Pin. 0.2 mm | Pin. 0.2 mm |
| 30 | 0.53 | — | 0.05 | 0.14 | Bal. | Pin. 0.3 mm | Pin. 0.3 mm |

Notes:
"Bal." denotes 'balance', "Pin. " denotes 'pinhole', and "I/C" denotes 'intercrystalline corrosion'.

It will be seen from Table 4 that the aluminum alloy Nos. 24 to 27 provided by the invention to manufacture heat exchangers proved corrosion-resistant with their excellent low-temperature corrosion resistance and high-temperature intercrystalline corrosion resistance. The reference alloy No. 28 lacking Fe and Ni proved inferior to them in the high-temperature intercrystalline corrosion resistance. The other reference alloy No. 29 rich in Fe was found bad in its low-temperature corrosion resistance, whereas the further reference alloy 30 rich in Cu as one of the unavoidable impurities proved inferior to the alloys in the invention in both types of the corrosion resistance.

Example 4

This example is for the Al-Zn alloys.

Aluminum alloys listed on Table 5 were formed into test pieces representative of the tubular elements in heat exchangers, on the same condition as that in Example 2.

The test pieces were subjected to the same corrosion tests as those in Example 2, the results obtained being listed on Table 5.

It will be seen from Table 5 that the aluminum alloy Nos. 31 to 34 provided by the invention to manufacture heat exchangers proved corrosion-resistant with their excellent low-temperature corrosion resistance and high-temperature intercrystalline corrosion resistance. The reference alloy No. 35 lacking Fe and Ni proved inferior to them in the hightemperature intercrystalline corrosion resistance.

TABLE 5

| Alloys | Composition (wt %) Zn | Fe | Ni | Cu | Al (purity) | Corrosion resistance at 95° C. | at 50° C. |
|---|---|---|---|---|---|---|---|
| Invention | | | | | | | |
| 31 | 1.01 | 0.08 | — | — | Bal.(≧99.9%) | Pin. ≦ 0.1 mm | Pin. ≦ 0.1 mm |
| 32 | 1.50 | — | 0.17 | — | Bal.(≧99.9%) | Pin. ≦ 0.1 mm | Pin. ≦ 0.1 mm |
| 33 | 0.53 | 0.27 | — | — | Bal.(≧99.9%) | Pin. ≦ 0.1 mm | Pin. ≦ 0.1 mm |
| 34 | 1.15 | 0.16 | 0.11 | — | Bal.(≧99.9%) | Pin. ≦ 0.1 mm | Pin. ≦ 0.1 mm |
| Reference | | | | | | | |
| 35 | 1.03 | — | — | — | Bal.(≧99.9%) | I/C 0.4 mm | Pin. ≦ 0.1 mm |
| 36 | 0.51 | 0.05 | — | 0.14 | Bal. | Pin. 0.3 mm | Pin. 0.3 mm |

Notes:
"Bal." denotes 'balance', "Pin. " denotes 'pinhole', and "I/C" denotes 'intercrystalline corrosion'.

The other reference alloy No. 36 rich in Cu as one of the unavoidable impurities proved inferior to the alloys in the invention in both types of the corrosion resistance.

What is claimed is:

1. A material for forming heat exchangers, the material consisting of: 0.1 to 0.8 wt % of Mg; 0.2 to 1.0 wt % of Si; 0.3 to 1.5 wt % of Mn; 0.01 to 0.3 wt % of Fe; and 0.01 to 0.3 wt % of Ni, wherein the balance of material consists essentially of aluminum of purity of 99.9% or higher and 0.1 wt % or less of unavoidable impurities contained therein, and the content of Cu as one of the impurities is 0.05 wt % or less, said material being further characterized by the fact that the pinhole corrosion of the material is less than or approximately equal to 0.1 mm when immersed in an ASTM solution comprising decuple water plus 10 ppm of Cu++at 95° C. or 50° C. for 500 hours.

2. A material as defined in claim 1, wherein the material contains 0.2 to 0.5 wt % of Mg, more than 0.4 wt % but up to 0.7 wt % of Si, 0.5 to 1.2 wt % of Mn, 0.03 to 0.15 wt % of Fe and 0.03 to 0.15 wt % of Ni.

* * * * *